US008961711B2

(12) United States Patent
Zurecki et al.

(10) Patent No.: US 8,961,711 B2
(45) Date of Patent: Feb. 24, 2015

(54) METHOD AND APPARATUS FOR NITRIDING METAL ARTICLES

(75) Inventors: Zbigniew Zurecki, Macungie, PA (US); Xiaolan Wang, Mt. Rainier, MD (US)

(73) Assignee: Air Products and Chemicals, Inc., Allentown, PA (US)

( * ) Notice: Subject to any disclaimer, the term of this patent is extended or adjusted under 35 U.S.C. 154(b) by 438 days.

(21) Appl. No.: 13/110,311

(22) Filed: May 18, 2011

(65) Prior Publication Data

US 2012/0118435 A1 May 17, 2012

Related U.S. Application Data

(60) Provisional application No. 61/347,654, filed on May 24, 2010.

(51) Int. Cl.
*C23C 8/00* (2006.01)

(52) U.S. Cl.
USPC ..... 148/232; 148/238; 118/723 R

(58) Field of Classification Search
USPC ..... 148/232, 238; 118/723 R
IPC ..... C23C 8/24; H01J 37/32064
See application file for complete search history.

(56) References Cited

U.S. PATENT DOCUMENTS

| | | | | |
|---|---|---|---|---|
| 5,989,363 | A | 11/1999 | Georges | |
| 6,086,684 | A | 7/2000 | Saito et al. | |
| 6,238,490 | B1 * | 5/2001 | Bell et al. | 148/222 |
| 2006/0048861 | A1 | 3/2006 | Watanabe et al. | |
| 2007/0204934 | A1 | 9/2007 | Hoshino et al. | |
| 2008/0283153 | A1 | 11/2008 | Zurecki et al. | |

FOREIGN PATENT DOCUMENTS

| | | | |
|---|---|---|---|
| CN | 1109513 | A | 10/1995 |
| EP | 0 872 569 | A1 | 10/1998 |
| EP | 2 226 405 | A1 | 9/2010 |
| JP | 07263193 | | 10/1995 |
| WO | 03/074752 | A1 | 9/2003 |
| WO | 2008124241 | | 10/2008 |

OTHER PUBLICATIONS

T. Bell, et al, Stainless Steel Low Temperature Nitriding and Carburizing, Advanced Materials & Processes, Jun. 2002.

(Continued)

*Primary Examiner* — Weiping Zhu
(74) *Attorney, Agent, or Firm* — Rosaleen P. Morris-Oskanian; Amy Carr-Trexler

(57) ABSTRACT

A method and apparatus for nitriding of highly-alloyed metal article is disclosed herein. In one embodiment, the method and apparatus uses at least one nitrogen source gas such as nitrogen and/or ammonia in an oxygen-free nitriding gas atmosphere, with small additions of one or more hydrocarbons. In this or other embodiments, the method and apparatus described herein is applicable to metal articles comprising iron, nickel and cobalt based alloys and which tend to form passive oxide films on at least a portion of their surface, heated to and nitrided at a certain temperature without prior surface preparation. The apparatus includes an external gas injector comprising 50-60 Hz AC, high voltage/low-current arc discharge electrodes, activating the nitriding atmosphere stream on its way from source to nitriding furnace.

7 Claims, 12 Drawing Sheets

(56) References Cited

OTHER PUBLICATIONS

Y. Sun, et al, Effect of carbon addition on low-temperature plasma nitriding characteristics of austenitic stainless steel, Vacuum Surface Engineering, 2006, 114-119, Vacuum 81.

X. Wang, Electric arc discharge activated, diluted ammonia nitrocarburizing of 300-series stainless steels poster presented at International Symposium on Surface Hardening of Corrosion-Resistant Alloys Conference May 25-26, 2010, Case Western Reserve University, Cleveland, OH.

* cited by examiner

9

10

[a]

[b]

[b]

[a]

310 SS nitrided at 565C for 4hr in plasma arc activated N2+1.25%CH4+25%NH3 atmosphere oxalic acid etched material cross-section with micro-hardness profile

METHOD AND APPARATUS FOR NITRIDING METAL ARTICLES

CROSS-REFERENCE TO RELATED APPLICATIONS

This application claims the priority benefit under 35 U.S.C. §119 of the following application: U.S. Provisional Application No. 61/347,654 filed 24 May 2010.

BACKGROUND OF THE INVENTION

Described herein is a method and apparatus for heat treating and/or thermochemical, diffusional surface processing of metal articles or parts. More specifically, described herein is a method and an apparatus for nitriding metal articles, such as but not limited to, stainless and other, high-alloy steels as well as nickel or cobalt rich superalloys.

Austenitic stainless steels (SS) are highly valued for their corrosion-, oxidation-, and thermal-resistance, toughness and ductility, even at cryogenic temperatures. These steels contain high levels of chromium (Cr), as well as nickel (Ni) and/or manganese (Mn) that help stabilize their austenitic structure. The high levels of Cr and the other, easily oxidizing alloy additions, especially Al and Mn, that tend to form passive oxide films on metal surface can be also found in many grades of ferritic/martensitic, duplex, and precipitation hardening stainless steels, iron-, nickel- and cobalt-based superalloys, tool steels, bearing steels, and white cast irons. In order to enhance wear resistance, especially in the case of easily scratching austenitic SS and superalloys and, in some cases, increase both hardness and corrosion resistance, it is desired to treat and harden the surface using nitriding, an inexpensive, thermochemical-diffusional process well proven in the field of low-alloy and carbon steels. Unfortunately, the passive oxide films forming on metal surface act as dense diffusion barriers preventing the conventional nitriding. Table 1 compares the free energy of formation (Gibbs energy) of iron (Fe) oxides to the energy associated with the oxides of easily oxidizing alloying additions frequently found in stainless and tool steels as well as superalloys. All energies (per oxygen and/or metal atom) that are more negative than those associated with Fe-oxides indicate the propensity for the forming of passive oxide films inhibiting the conventional, and the most cost effective gas nitriding using ammonia ($NH_3$) atmospheres.

TABLE 1

Free Energy of Oxide Formation at 500° C.

| Oxide | Delta G (kJ/mol) Energy per Oxide | Delta G (kJ/O-g. at) mol) Energy per Oxygen | Delta G (kJ/M-g. at.) Energy per Metal |
|---|---|---|---|
| FeO | −214 | −214 | −214 |
| $Fe_3O_4$ | −860 | −215 | −287 |
| $Fe_2O_3$ | −616 | −205 | −308 |
| MnO | −328 | −328 | −328 |
| $Mn_3O_4$ | −1,118 | −280 | −373 |
| $Mn_2O_3$ | −756 | −252 | −378 |
| $Cr_2O_3$ | −929 | −310 | −464 |
| $V_2O_3$ | −1,009 | −336 | −505 |
| $V_2O_5$ | −1,212 | −242 | −606 |
| $V_3O_5$ | −1,617 | −323 | −539 |
| NbO | −349 | −349 | −349 |
| $NbO_2$ | −653 | −326 | −653 |
| TiO | −467 | −467 | −467 |
| $TiO_2$ | −803 | −401 | −803 |
| $ZrO_2$ | −952 | −476 | −952 |

TABLE 1-continued

Free Energy of Oxide Formation at 500° C.

| Oxide | Delta G (kJ/mol) Energy per Oxide | Delta G (kJ/O-g. at) mol) Energy per Oxygen | Delta G (kJ/M-g. at.) Energy per Metal |
|---|---|---|---|
| $SiO_2$ | −770 | −385 | −770 |
| $Al_2O_3$ | −1,433 | −478 | −717 |

Equilibrium Calculated using Software Package HSC Chemistry v. 5.0

Practical applications of metal alloys in corrosive and oxidizing environments, as well as practical observations of metal surface responses to various heat treating atmospheres or thermochemical treatments indicate that the highly alloyed, oxide film-passivating metal alloy articles contain at least 10.5 wt % Cr and at least 0.2 wt % of any of the following alloy additions in any combination or combined as a sum: Mn, Si, Al, V, Nb, Ti, and Zr.

Many methods have been developed to date in order to overcome the problem of passive oxide films during nitriding, nitrocarburizing and carbonitriding treatments in controlled atmosphere furnaces. Thus, the metal surface could be dry-etched at elevated temperatures in halide gases such as hydrochloric acid (HCl) or nitrogen trifluoride ($NF_3$). This surface etching step, taking place in a corrosion resistant reactor equipped with toxic gas scrubbers, is immediately followed by nitriding or, alternatively, carburizing. Exposure to ambient air is avoided until the diffusion treatment is completed. The method is effective but requires a prolonged, multi-hour processing time, and necessitates significant capital, safety equipment, and maintenance expenditures. Process alternatives may include electrolytic etching and deposition of protective Ni-films preventing passive film formation. Of note, many legacy processes involved oxide dissolution and diffusional treatment in somewhat haphazard molten salts baths, typically containing very large quantities of liquid-phase, toxic cyanides.

Another, popular method involves low-pressure (vacuum furnace) nitriding using plasma ion glow discharges directly at the metal surface. Usually, this process takes more hours than gas nitriding in the ammonia atmospheres, its nitrogen deposition rate is comparably slow, and requires the metal parts to be one electrode with a conductive metal mesh suspended above the parts to be another. Ion sputtering action taking place in this process is sufficient to remove oxide films and enable the subsequent diffusional treatment. The key limitation is the part geometry—due to the configuration of mesh electrode, electrostatic fields formed and ion discharges directly over metal surface-treatment of parts containing holes, groves, or other special topographic features is difficult. Also, the cost of the entire system including high-power electric supplies, pumps and sealing is significant, temperature control of metal surface during the process is problematic due to ionic heating, and the thickness of nitrided case is comparatively low.

Thus, the metal processing industries need further improved thermochemical-diffusional treatments that will be capable of nitriding and surface hardening of stainless and other, high-alloy steels and superalloys in a cost-effective, safe, and rapid manner.

BRIEF SUMMARY OF THE INVENTION

At least one or more of the needs of the art is satisfied by the method and apparatus described herein. In one aspect, there is provided a method of nitriding a metal article to provide a treated surface comprising: providing the metal article within a furnace; introducing into an inlet of the furnace a gas atmosphere comprising a nitrogen source and a hydrocarbon gas wherein the gas atmosphere is substantially free of an added oxygen gas or oxygen-containing source gas; heating the metal article in the gas atmosphere at a nitriding temperature ranging from about 350° C. to about 1150° C. or from about 400 to about 650° C. for a time effective to provide the treated surface. In one particular embodiment, the nitrogen source gas comprises nitrogen gas ($N_2$). In another embodiment, the nitrogen source gas comprises nitrogen gas and ammonia ($NH_3$);

In another aspect, there is provided an apparatus for nitriding a metal article comprising: an externally located, electric arc-activation gas injector employing a low-power, high-voltage, non-pulsed, AC arc discharge, changing polarity from 50 to 60 times per second, where the peak-to-valley voltage ranges from 1 kV to 12 kV and wherein a current of the high-voltage arc discharge does not exceed 1 ampere.

DETAILED DESCRIPTION OF THE INVENTION

Figure 1:
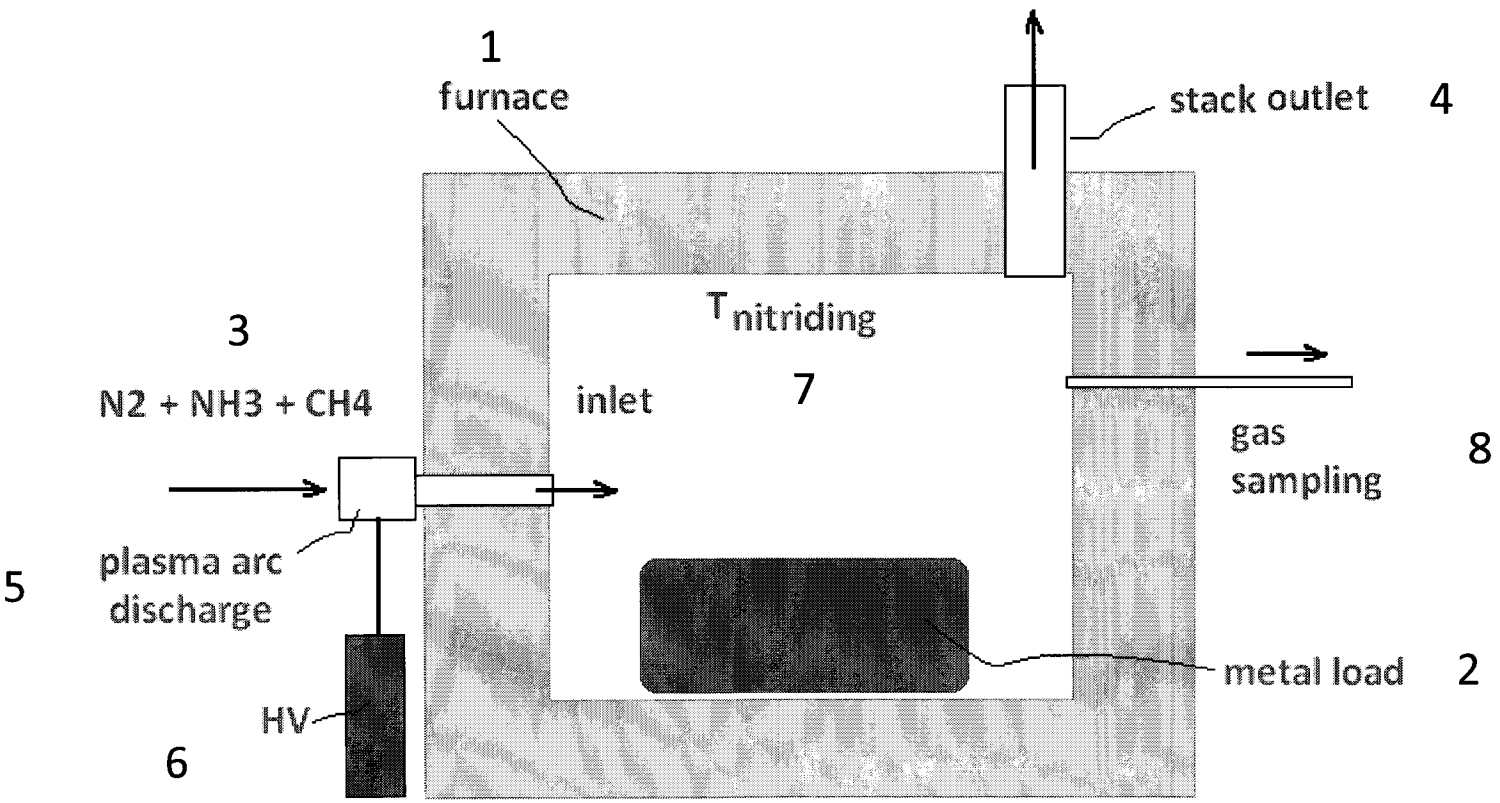
FIG. 1 provides an embodiment of the nitriding system disclosed herein.

In order to meet the objectives set forth, the method and apparatus described herein is used to treat such as, but not limited to, nitride, carbonitride, or carburize highly alloyed metal articles that involves a new type of nitriding or treating atmosphere and, optionally, an additional, new type of atmosphere stream activation at the gas inlet port involving a cold (non-equilibrium/non-thermal) electric arc discharge across this gas stream. The term "treat" or "treating" as used herein means without limitation nitride, carburize, or carbonitride. In conventional nitriding processes, the furnace nitriding atmosphere typically contains $NH_3$, $N_2$, and hydrogen ($H_2$); the latter two resulting from the $NH_3$ dissociation in an external ammonia dissociation unit, prior to introducing these gases into treatment furnace. In contrast, the furnace atmosphere used in the method and apparatus described herein does not require the external dissociator and uses an undissociated $NH_3$ diluted in cryogenic-quality $N_2$. This may provide certain cost and operational benefits associated with the elimination of dissociator.

In certain embodiments of the method and apparatus described herein, the atmosphere described herein is designed to operate at one or more treating or nitriding temperatures ranging from about 350° C. to about 1150° C. or from about 400° C. to about 600° C. With regard to the nitriding or treating temperature, any one or more of the following temperatures is suitable as an end point to the treating or nitriding temperature range: 350° C., 400° C., 450° C., 500° C., 550° C., 600° C., 650° C., 700° C., 750° C., 800° C., 850° C., 900° C., 950° C., 1000° C., 1050° C., 1100° C., or 1150° C. It is observed that lower nitriding temperatures (e.g., below about 400° C. or below 350° C.) necessitate an unreasonably long, multi-day treatment time. However, the higher nitriding temperatures (e.g., above 650° C. or above 1150° C.) may result in the precipitation of carbides in the core of many austenitic alloys, during the treatment or during the cooling from the treatment temperature leading to undesired sensitization embrittlement, and/or may prevent the formation of so-called S-layer, i.e. nitrogen-expanded austenite phase, if the formation of such a nitrogen-rich layer is desired. However, in certain embodiments, higher temperature treatments (e.g., from about 650° C. to 1150° C.) can be used with the method disclosed herein if the formation of hard nitride and/or nitrocarbide compound film in the metal surface is desired, the formation of so-called S-layer (expanded austenite layer) is not critical, and the original alloy composition and the cooling rate from the treatment temperature are suitable for thermal treatments at these higher temperatures. In certain embodiments, the treatment temperature and the molar ratio of ammonia to hydrocarbon gas in the nitrogen-ammonia-hydrocarbon gas blend is controlled using a central processing unit (CPU), computer processor, or other means to achieve the desired nitrided, nitrocarburized and/or carbonitrided layers on the metal article treated.

The method and apparatus described herein can be used to surface treat a metal article which is comprised of at least one metal selected from stainless steel (e.g., austenitic, ferritic, martensitic, duplex, or precipitation hardened stainless steels); superalloy (e.g., a iron-, nickel-, and cobalt-based superalloy); tool steel, bearing steel, cast iron products, and mixtures thereof. In these or other embodiments, the metal article is not subjected to a prior surface treatment. In one or more embodiments, the metal article has a tendency to form a passive oxide films on at least a portion of their surface. The oxide film passivation tendency of the metal alloy is, normally, desired from the corrosion-resistance standpoint but creates significant difficulty in the conventional nitriding treatments.

In one embodiment of the method and apparatus described herein, the nitriding atmosphere is absent an oxygen source or is substantially oxygen free, has less than 500 ppm (parts per million) oxygen or less than 300 ppm oxygen or less than 100 ppm by overall weight of oxygen. The gas atmosphere described herein comprises one or more nitrogen-containing gases such as, but not limited to, nitrogen ($N_2$) cryogenic grade (4N-5N) nitrogen; ammonia ($NH_3$) such as, but not limited to, pure, anhydrous ammonia; and optionally minor (e.g., up to about 2.5 vol %) additions of a hydrocarbon gas such as, but not limited to, pure natural gas, a hydrocarbon (such as, but not limited to, methane ($CH_4$), ethane, propane, etc.), and combinations thereof. In certain embodiments, the nitrogen-containing gas is nitrogen. In other embodiments, the nitrogen-containing gas comprises nitrogen and ammonia. In one particular embodiment, the furnace atmosphere may range from 50 to 89.75 vol % of $N_2$, from 10 to 50 vol % of $NH_3$; and from 0.25 to 2.5 vol % for $CH_4$. As previously mentioned, in certain embodiments of the method and apparatus used herein, no oxygen sourcing gases, such as, but not limited to, carbon monoxide (CO), carbon dioxide ($CO_2$), nitrogen oxides, water vapor ($H_2O$), or alcohol vapors are introduced into the nitriding furnace. It is believed that oxygen source-free atmospheres comprising $N_2$ and $NH_3$ are more nitriding toward steels that the conventional, dissociated ammonia atmospheres, even if both these atmospheres happen to contain the same amount (number of moles) of undissociated $NH_3$ at the inlet to the treatment furnace. This difference in nitriding ability is more desirable to the end user because the $N_2$-diluted $NH_3$ atmospheres allow the end user to reduce the consumption of toxic and flammable $NH_3$ and the size of on-site $NH_3$ storage vessel. While not being bound by theory, it is believed that the improved nitriding with $N_2$-diluted $NH_3$-atmospheres may be related to the so-called nitriding potential, Kn, calculated from the ratio of $NH_3$ and $H_2$ partial pressures in the furnace atmosphere according to the well known equation (1), below:

$$Kn = pNH_3/(pH_2)^{1.5} \quad \text{(Equation 1)}$$

wherein $pNH_3$ is the partial pressure of $NH_3$, or the volumetric concentration of $NH_3$ inside furnace for 1-atmosphere pressure operations, and $pH_2$ is the partial pressure of $H_2$.

Table 2 presents a hypothetical situation, wherein 100 moles of gas are fed to nitriding system in both cases 1 and 2. The $1^{st}$ stream is $NH_3$, further dissociated in external dissociator to the point that 75% of the original $NH_3$ breaks into $H_2$ and $N_2$, and only 25 moles enter the furnace undissociated. The $2^{nd}$ stream comprises 25 moles of undissociated $NH_3$ diluted in 75 moles of $N_2$. Complete equilibrium in furnace atmosphere at 500° C. would yield residual $NH_3$, $H_2$, and $N_2$ products which, in the case of the diluted $NH_3$ stream, result in a 1.7-times larger nitriding potential of the latter. This suggests that the diluted $NH_3$ stream can nitride metals better. Also, the endothermic effect of the $2^{nd}$ stream on furnace atmosphere is 1.4-times smaller, and endothermic effects are not desired because it impedes reaction kinetics. In the real, industrial applications, the amount of $NH_3$ never goes to equilibrium level inside furnace. This means that the nitriding potential of both atmosphere streams shown in Table 2 is, in reality, orders of magnitude higher and, also, that the ratio between the nitriding potential of the $2^{nd}$ stream and the $1^{st}$ stream is even larger than the value 1.7 calculated below.

TABLE 2

| | Equilibrium composition after heating gas blend in furnace to 500 deg. C. where Kn = pNH3/pH2^1.5 | | | | | | endotherm del.H [MJ] |
|---|---|---|---|---|---|---|---|
| | 25 deg. C. gas stream at furnace inlet | 25 deg. C. moles or vol %-input | partial press.-output in-furnace | | | Kn | |
| | | | NH3 [atm] | H2 [atm] | N2 [atm] | | |
| 1 | 75% dissociated ammonia | 25NH3 + 37.5N2 + 112.5H2 | 1.3E-03 | 0.75 | 0.25 | 2.00E-03 | 3.930 |
| 2 | undissociated ammonia diluted using N2 gas | 25NH3 + 75N2 | 5.5E-04 | 0.30 | 0.70 | 3.35E-03 | 2.909 |
| | | | | | | | |
| | | effect of N2-dilution: | nitriding potential increase: | | | 1.7 | |
| | | | endothermicity reduction: | | | 1.4 | |

equilibrium gas concentrations were calculated using thermodynamic software package FactSage v.6.1 (May 2009)
the starting amount of gas fed to nitriding process is equal 100 moles in both cases 1 and 2

In certain embodiments, the gas atmosphere further comprises a hydrocarbon, such as but not limited to, a saturated hydrocarbon (e.g., methane ($CH_4$), ethane ($C_2H_6$), propane ($C_3H_8$), etc.), an unsaturated hydrocarbon (e.g., ethylene ($C_2H_4$), propylene ($C_3H_6$), etc.), natural gas or combinations thereof. Without being bound by theory, it is believed that nitriding low-alloy steels with a gas atmosphere, not activated by the electric arc discharge and containing a small addition of the hydrocarbon such as, but not limited to methane to $N_2$ or $NH_3$-containing atmospheres does not lead to $CH_4$ dissociation below about 1000° C. and does not lead to metal carburizing at temperatures lower than about 650° C., depending on the composition of metal. Hence, the addition of a hydrocarbon such as $CH_4$ to the $N_2$-diluted $NH_3$ atmospheres is not expected to result in carburizing of metal surface at or below 650° C., a reaction that would be undesired as it that might block the diffusion of atomic nitrogen into metal. What small additions of hydrocarbon (e.g., 2.5 volume % or below) of $CH_4$ were believed to do at those relatively low furnace temperatures when electric arc discharge was used was neutralizing or removal of oxygen impurities and/or thin oxide films from the metal surface. This is a desired effect in the case of nitriding of highly alloyed metal articles which tend to form stable, passive oxide films preventing nitrogen adsorption and diffusion. It is believed that many other, heavier and less thermodynamically stable hydrocarbons, e.g. ethylene ($C_2H_4$), propylene ($C_3H_6$), propane ($C_3H_8$) or acetylene ($C_2H_2$), could be used instead of $CH_4$ to perform the same, oxygen scavenging task, but the concentration of these gases in the gas atmosphere of the furnace must be lower than that of $CH_4$ and selected in such a way that it does not result in metal carburizing or sooting. In one embodiment, the upper concentration limit for those alternative hydrocarbons could be set by dividing the upper concentration limit of $CH_4$ by the number of carbon atoms in the molecules of the alternative gases.

As previously mentioned, the nitriding treatment of the metal article is conducted at one or more temperatures ranging from about 350° C. to about 1150° C. or from about 400° C. to about 650° C., In certain embodiments, the heating to the nitriding treatment temperature may take place under the stream of continuously running $N_2$ until the nitriding temperature is reached prior to the introduction of the nitriding gas atmosphere. In alternative embodiments of the method described herein, the stream of the nitriding gas atmosphere comprising, for example $N_2$, $NH_3$, and $CH_4$, is introduced while the furnace is heated up to the desired nitriding temperature.

In one particular embodiment, the hydrocarbon addition to the nitriding gas or treating gas atmosphere is used only during the first step of heating the metal article to the desired nitriding temperature and the rest of the nitriding process is carried out in an atmosphere comprising, at the inlet to the furnace, from 10 to 50 vol % of undissociated ammonia diluted in from 50 to 90 vol % of cryogenic quality nitrogen. In these or other embodiments, the nitrogen source gas in nitriding or treating gas atmosphere comprises cryogenic nitrogen and wherein the cryogenic nitrogen is used during the first step of heating metal to the nitriding temperature.

In certain embodiments, the metal article is cooled after treatment with the nitriding gas atmosphere. The cooling step can be performed under the stream of nitriding or inert gases inside the furnace or alternatively by liquid quenching. Longer or shorter nitriding time intervals at higher or lower nitriding temperatures can also be used to modify the structure and composition of nitrided layers, depending upon the desired application.

In certain embodiments, the gas atmosphere described herein is activated at the furnace inlet using a modified version of the electric arc discharge system disclosed in U.S. Publ. No. 2008/0283153(A1), which is assigned to the Applicant of the present application and is incorporated herein by reference in its entirety. The electric system comprises two counter-electrodes striking a low-power, high-voltage arc across the stream of gas injected into furnace. The voltage drop, peak-to-valley, across the gas is more than 1 kV, and preferentially ranges from about 10 kV to about 12 kV. The arc current is low, typically measured in milliamperes, and not exceeding 1,000 mA, in order to prevent an undesired electrode and gas heating. This type of electric discharge is sometimes characterized as a cold or non-equilibrium arc discharge because the arc tends to form filamentous branches that collapse and re-establish themselves and a spacial glow discharge around these filaments. In these embodiments, the power supply system producing the arc comprises only one or more inexpensive step-up transformers, excluding the need for electric discharge pulsing with special electronic circuitry found in the popular radio-frequency (RF) plasma generators. The power grid supplying energy to this system is a simple residential AC, 50 Hz-60 Hz, 115 V-230 V. Thus, the polarity of the arc discharge changes only from 50 to 60 times per second. In one particular embodiment of the method described herein, the method uses electric arc discharge for the activation of the nitriding, $NH_3$ and $CH_4$ containing stream or nitriding gas atmosphere. In this or other embodiments, electric arc discharge can be, turned on during heating-up of the furnace before the nitriding gas atmosphere is reached. In one particular embodiment, the electric arc discharge is activated while a continuous stream of $N_2$ is introduced into the furnace.

The main difference between an electric arc activation system and the system described herein is the location of the gas injector and gas temperature within the arc discharge volume. An electric arc activation system locates the arc-discharge injector inside the furnace, in the hot zone, in order to maximize the ionization of gas molecules. In certain embodiments of the method and apparatus described herein, the arc-discharge injector is located outside the furnace, in the area where both the gas stream and the injector are at room temperature (e.g., 25° C.). This difference is based on additional experiments leading to the recognition by Applicants that the diluted $NH_3$ nitriding atmospheres do not require as high a degree of ionization and thermal dissociation to be effective. However, in other embodiments of the method and apparatus described herein, the arc-discharge injector may be located inside the furnace in the hot zone.

FIG. 1 represents an embodiment of nitriding system described herein comprising a heated furnace or reactor, 1, highly alloyed metal load or metal article to be nitrided 2, a diluted $NH_3$ gas stream further comprising $N_2$ and $CH_4$ entering the furnace from supply vessels (not shown) 3, stack or gas atmosphere outlet, 4, an external arc-discharge activation system, 5, and its high voltage (HV) power supply 6, that could be turned on or off without upsetting gas flow, if no electric activation is used. In the embodiment shown in FIG. 1, the furnace heating elements (not shown) can be conventional: electric, or radiant. critical furnace heating elements heat the metal charge to the requisite nitriding temperature because the plasma source is cold relative to the furnace heating elements. The furnace required for the treatment is the conventional metallurgical case hardening furnace designed for the operations with flammable gases. Thus, the treatment can be carried out in box and muffle furnaces, integral quench furnaces, retorts and low-pressure (vacuum) furnaces at the 1-atmosphere pressure as well as reduced and elevated pressures. In all embodiments, the furnace used for the treatment must have its own heating system, electrical or combustion-based and utilizing popular radiant tubes. The nitriding temperature 7, is maintained using a thermocouple or other means (not shown) that is electrical communication with a processor or central processing unit (CPU) or other means to maintain the temperature range of from about 350° C. to about 1150° C., or about 400° C. to about 650° C. and the composition of the gas atmosphere is, optionally, sampled via port 8 for process control and is in electrical communication with a process or CPU (not shown).

The following examples illustrate the method for nitriding a metal article and apparatus described herein and are not intended to limit it in any way.

EXAMPLES

Example 1

Figure 2:
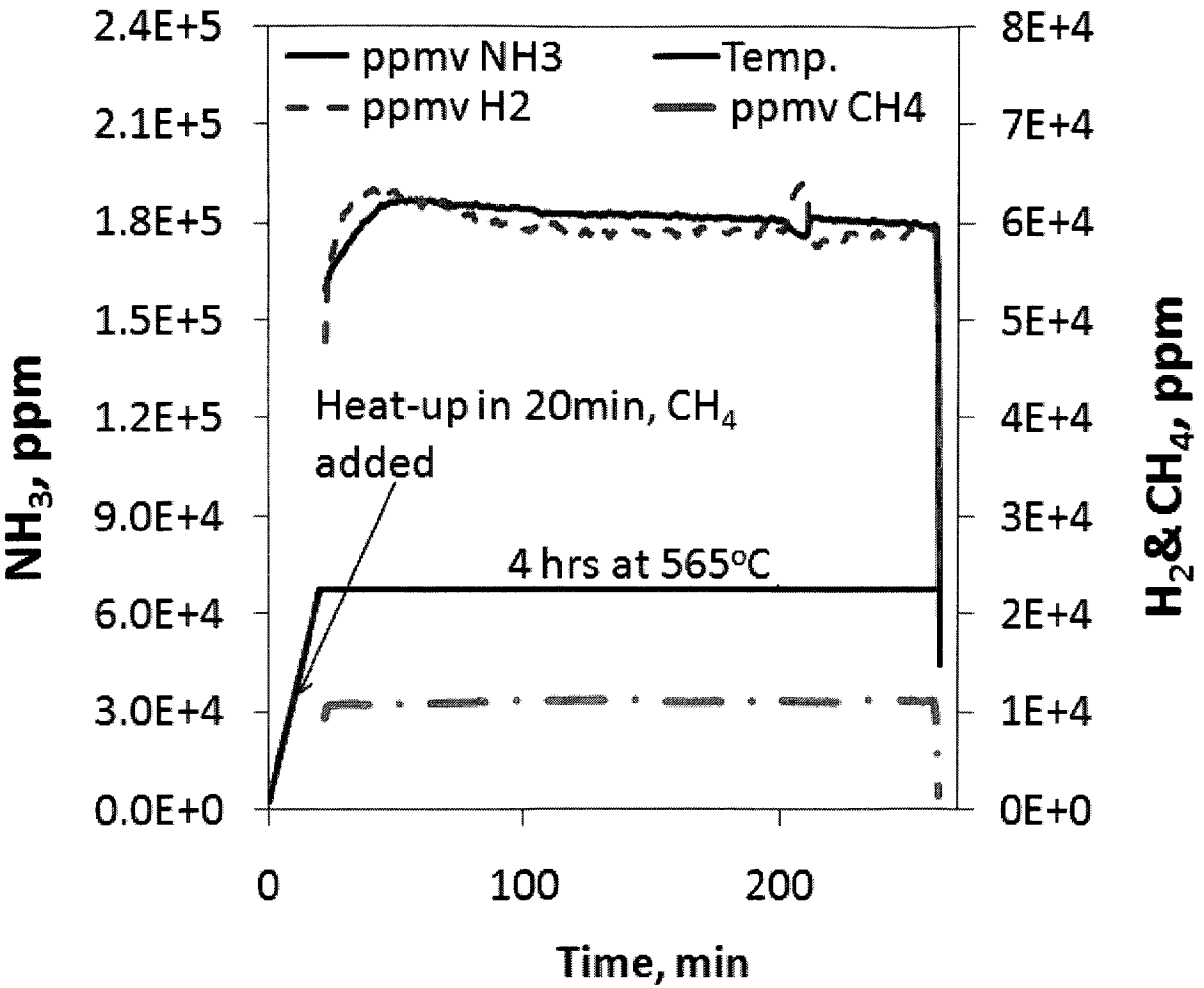
FIG. 2 provides an example of an embodiment of a schedule for the nitriding method described herein that depicts the $N_2$, $NH_3$, $H_2$ and $CH_4$ atmosphere expressed in parts per million (ppm) versus time in minutes of Example 1.

Nitriding of a SAE 301 Stainless Steel Coupon using a Gas Atmosphere containing Methane FIG. 2 provides the typical nitriding schedule according to an embodiment of the method described herein that depicts the amount of $NH_3$, $H_2$, and $CH_4$ in parts per million (ppm) present in the gas atmosphere of the furnace versus time. A metal article comprised of a 301 stainless steel (SS) coupon which is an austenitic stainless steel with the nominal wt % composition of carbon, 0.15 max., manganese 2.00 max., silicon 0.75 max., chromium 16.00-18.00, nickel 6.00-8.00, nitrogen 0.10 max., and the iron balance is placed inside an atmospheric-pressure furnace which has a configuration similar to that depicted in FIG. 1. Prior to the introduction of the nitriding gas atmosphere, cryogenic-quality, pure $N_2$ stream is run through the furnace until all air and residual moisture are removed. In the $2^{nd}$ step, when all air and moisture (oxygen sources) are removed, the furnace heaters are turned on so that the load reaches the nitriding temperature of 565° C. as shown in FIG. 2. In the embodiment shown in FIG. 2, a stream of nitrogen gas was introduced into the furnace until the nitriding temperature of 565° C. was reached and then the nitriding gas atmosphere comprising 25 vol % $NH_3$, 1.25 vol % $CH_4$, and $N_2$ balance was introduced. The present example involved arc-activation using two step-up transformers converting 120 V, 60 Hz, AC into a high-voltage (about 10 kV), low-current (about 160 mA), and 60 Hz discharge. The electric discharge was turned on after the pure $N_2$ stream was replaced with the $N_2$-25% $NH_3$-1.25% $CH_4$ stream (e.g., after the nitriding temperature of 565° C. was reached). The 3$^{rd}$ step of the treatment involves holding the metal load under the activated nitriding gas atmosphere for 4 hours at 565° C. A laser gas analyzer was used to monitor atmosphere concentration inside the furnace during the treatment. As shown in FIG. 2, the concentration of $NH_3$ inside the furnace dropped from the initial 25 vol % at the gas inlet to about 18 vol %. The concentration of $CH_4$ dropped much less but was somewhat lower than 1.25 vol %, the initial inlet value. About 6 vol % of in-situ formed $H_2$ was also detected due to the arc, furnace and metal surface reactions. The nitriding potential, Kn, calculated from equation (1) was a relatively high value of 12.24. It should be stressed, that the present nitriding atmosphere cannot be directly compared to the conventional, dissociated $NH_3$ atmospheres having the same nitriding potential, because the conventional atmospheres would have to have $NH_3$ concentrations inside the furnace many times higher than the present 18 vol % to reach such a high potential.

Figure 3:
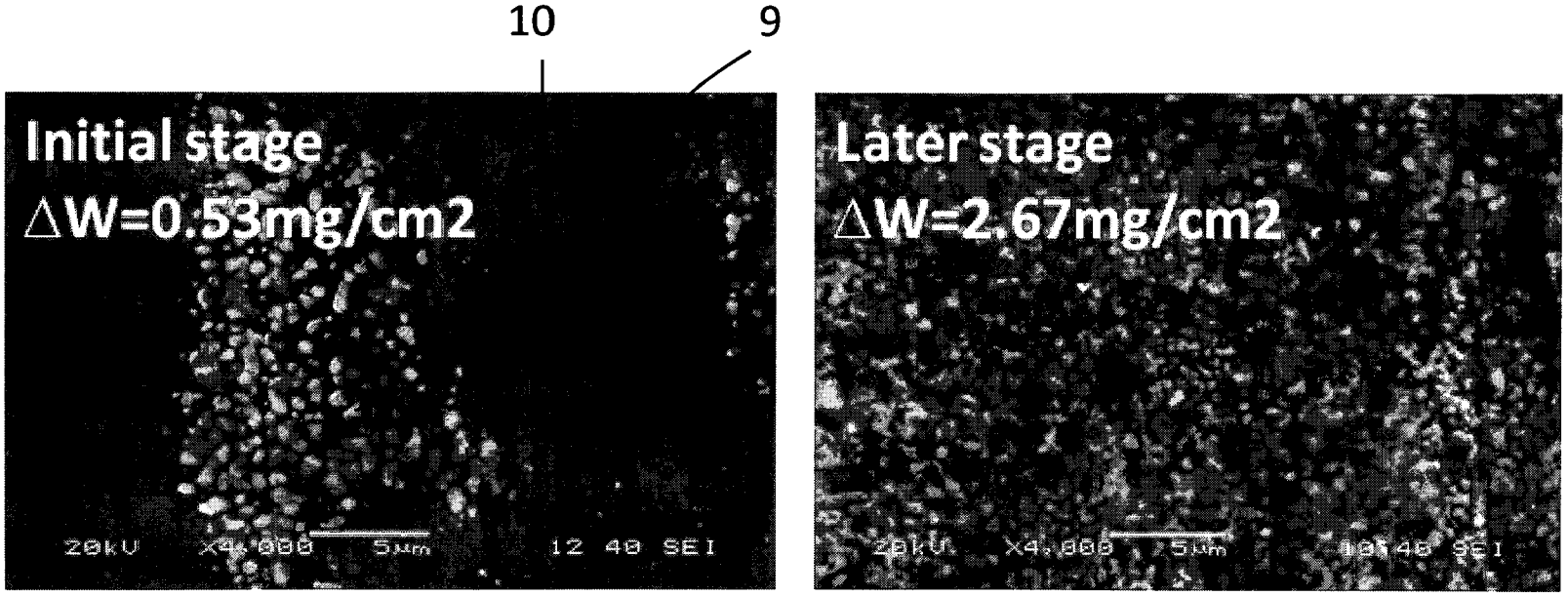
FIGS. 3*a* and 3*b* are scanning electron microscope (SEM) pictures taken of the surface of a Society of Automotive Engineers (SAE) 301 stainless steel coupon in an initial and later stage, respectively, that was treated using the method described herein at a temperature of 565° C.
Figure 9:
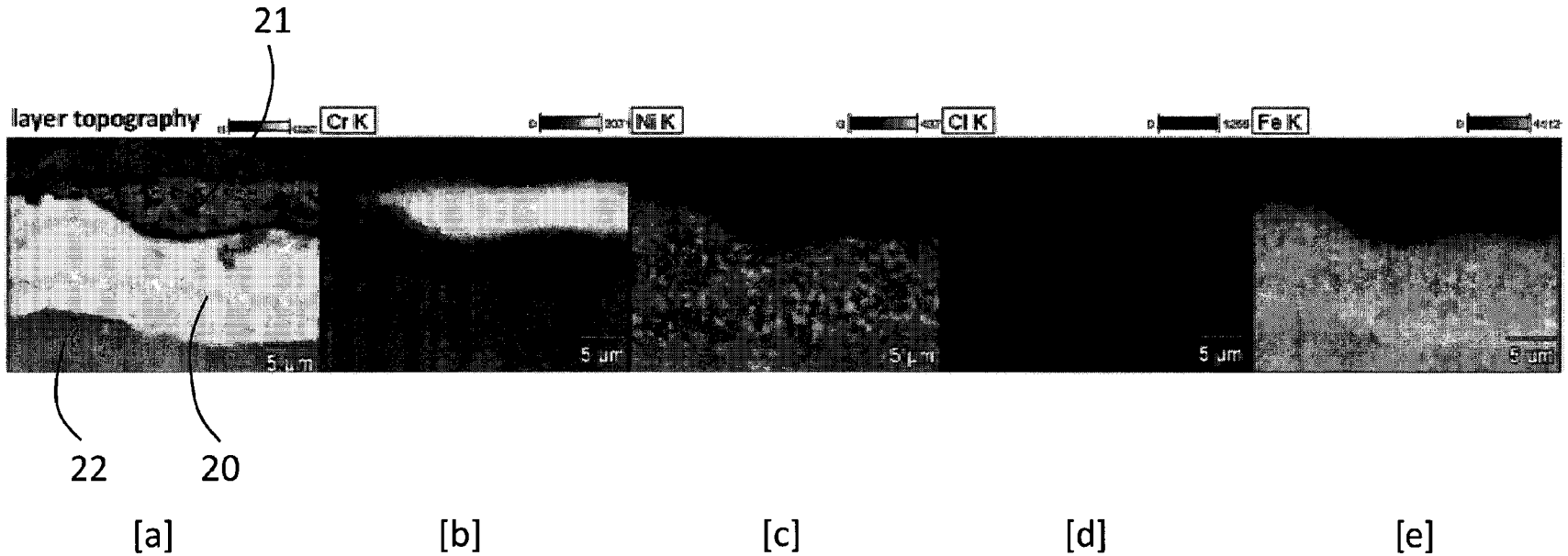
FIGS. 9*a* through 9*e* provide elemental dot maps of nitride- and S-layers of the austenic steel SAE 304 stainless steel coupon of FIG. 8.

FIG. 3 shows microscopic crystallites growing on the surface of 301 SS coupons after the first minutes of nitriding treatment at 565° C. using the method described herein. As the treatment time progressed from [a] to [b], the entire metal surface becomes covered with the crystallites. The weight gain of metal coupons shown, delta W, corresponding to the crystallite coverage, suggests early stages of nitriding. Referring to FIG. 3*a*, 9 indicates fresh metal surface and 10 the first crystallites on the surface.

Figure 4:
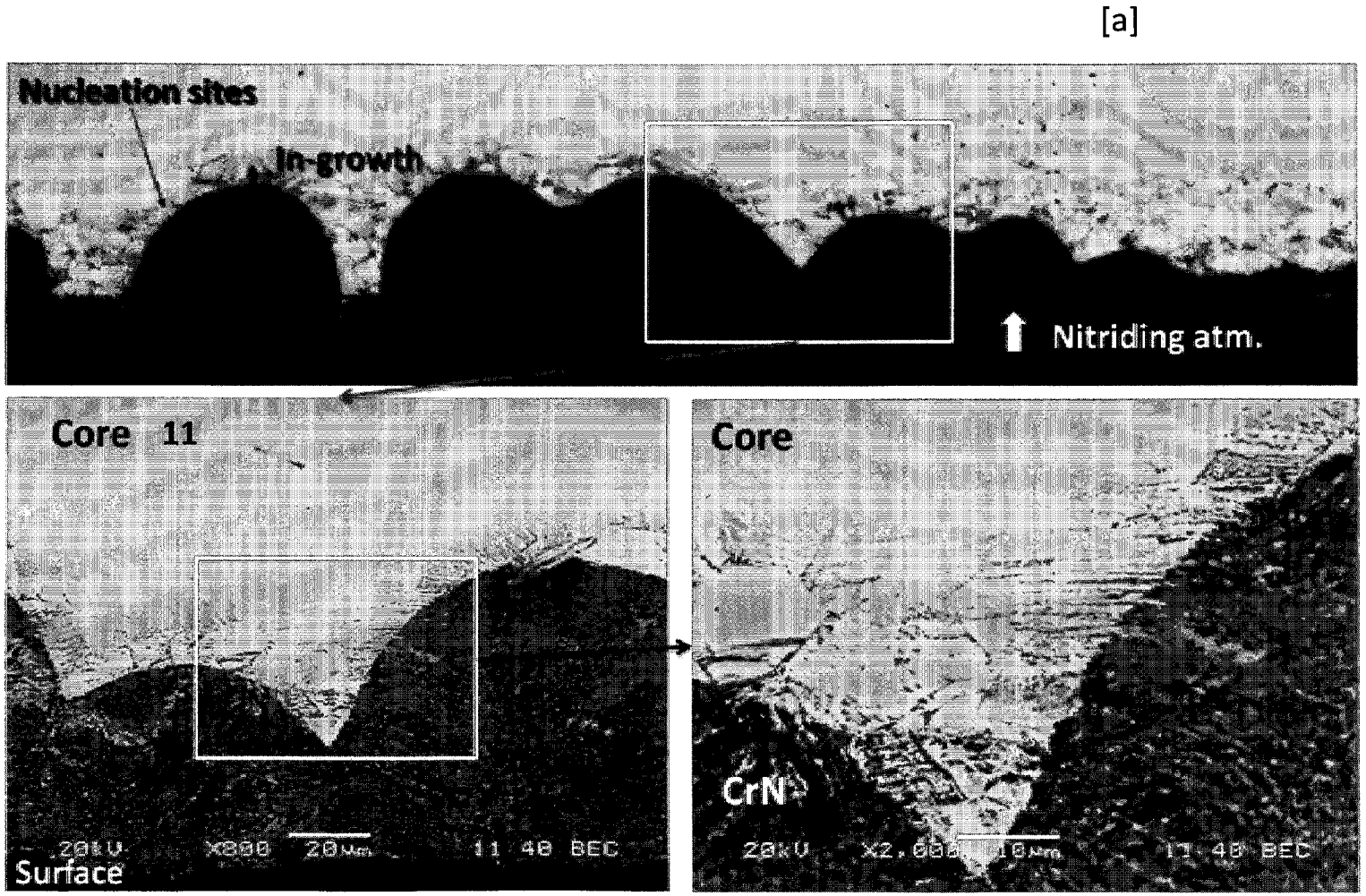
FIGS. 4*a*, 4*b*, and 4*c* are SEM pictures of cross sections of metal surfaces of the nitride surface in various process stages.
Figure 11:
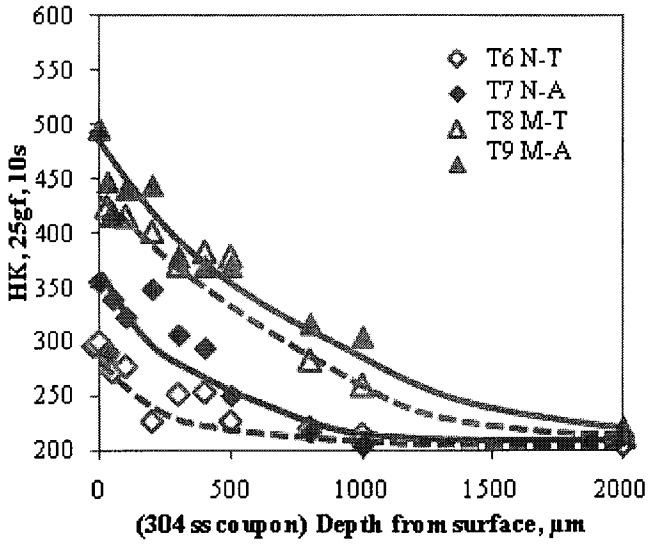
FIG. 11 provides the microhardness profile for the various SAE stainless steel 304 test coupons described in Example 4.

FIG. 4 provides an oxalic acid etched cross section of the metal surfaces covered by the crystallites identified in FIG. 3. The micrographs suggest that the nitriding process in this example starts with a few selected nucleation sites rather than uniformly, and that these surface nuclei, once formed, grow into the parent metal, joining together into a uniform layer at a later stage. The initial absence of a planar growth front is interpreted by applicants as the consequence of the $N_2$—$NH_3$—$CH_4$ atmosphere used and its site-activating effect on metal surface. The distribution of active sites at the metal surface leading to the nitride nucleation and the nitride layer growth are believed to be controlled by the electric arc discharge activated molecules and radicals of the nitriding gas atmosphere that can be controlled by the $NH_3/CH_4$ molar ratio. Referring to FIGS. 4*b* and 4*c*, 11 indicate a largely unaffected metal core, and 12 show the nucleate growing into metal core and comprising a large fraction of Cr-nitrides. Micrographs [a], [b], and [c] show the detail under an increasing magnification. The nucleation and growth of the nitrided layer is so fast that the no nitrogen diffusion layer is observed in these coupons to separate the nitride region from the unaffected core material region.

Figure 5:
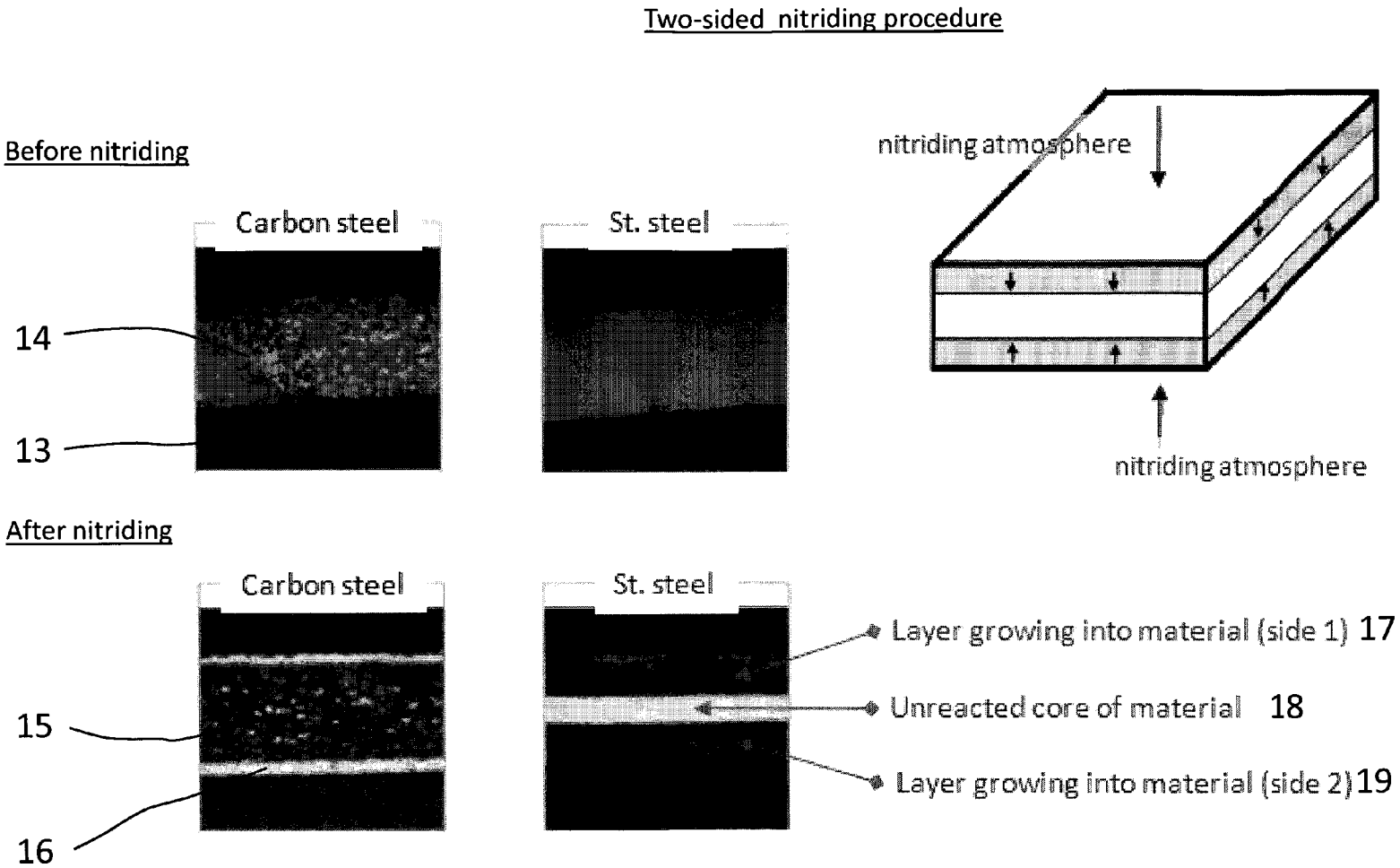
FIG. 5 provides an illustration of nitride growth layer for carbon and austenitic stainless steels.

FIG. 5 presents Nital etched cross sections of metal shims after 4-hour nitriding treatment according to this invention during one furnace loading cycle, side-by-side. These shims are made of two different steels: a low carbon steel (AISI 1008-grade) and SAE 301 SS. Both types of shims are 200 micrometer thick, and were exposed to nitriding from both sides. The two upper micrographs show the shims before the treatment, and the two lower micrographs show the nitrided shims. The white layers at the surface of nitrided carbon steel shim indicate the depth of nitriding. The dark layers growing from the surface into the core of the 301 SS shim indicate the depth of nitriding; the white strip in the core is the unaffected parent metal. The difference in color response may be the consequence of different etching rates—nitrided iron is more resistant to Nital etching than the parent iron, and the nitrided SS is less resistant to etching than the parent SS. The key finding shown in FIG. 5 is the difference in the thickness of nitrided layers: the layers growing into 301 SS are over 4-times thicker than the layers growing into low carbon steel. This finding is unexpected and suggests that the nitriding gas atmosphere comprising $N_2$—$NH_3$—$CH_4$ is uniquely suited for nitriding of highly-alloyed metals which tend to resist the conventional nitriding methods due to the presence of Cr-rich, passive oxide films. Referring again to FIG. 5, 13 indicates metallographic mount of the sample, 14 is Nital etched carbon steel shim before treatment, 15 is the unaffected carbon steel core after the nitriding treatment of the present invention, 16 is the nitride layer forming on carbon steel as a result of the treatment, 17 and 19 are the alloyed nitride layers growing into the stainless steel shim, and 18 is the stainless steel material core largely unaffected by the treatment.

Figure 6:
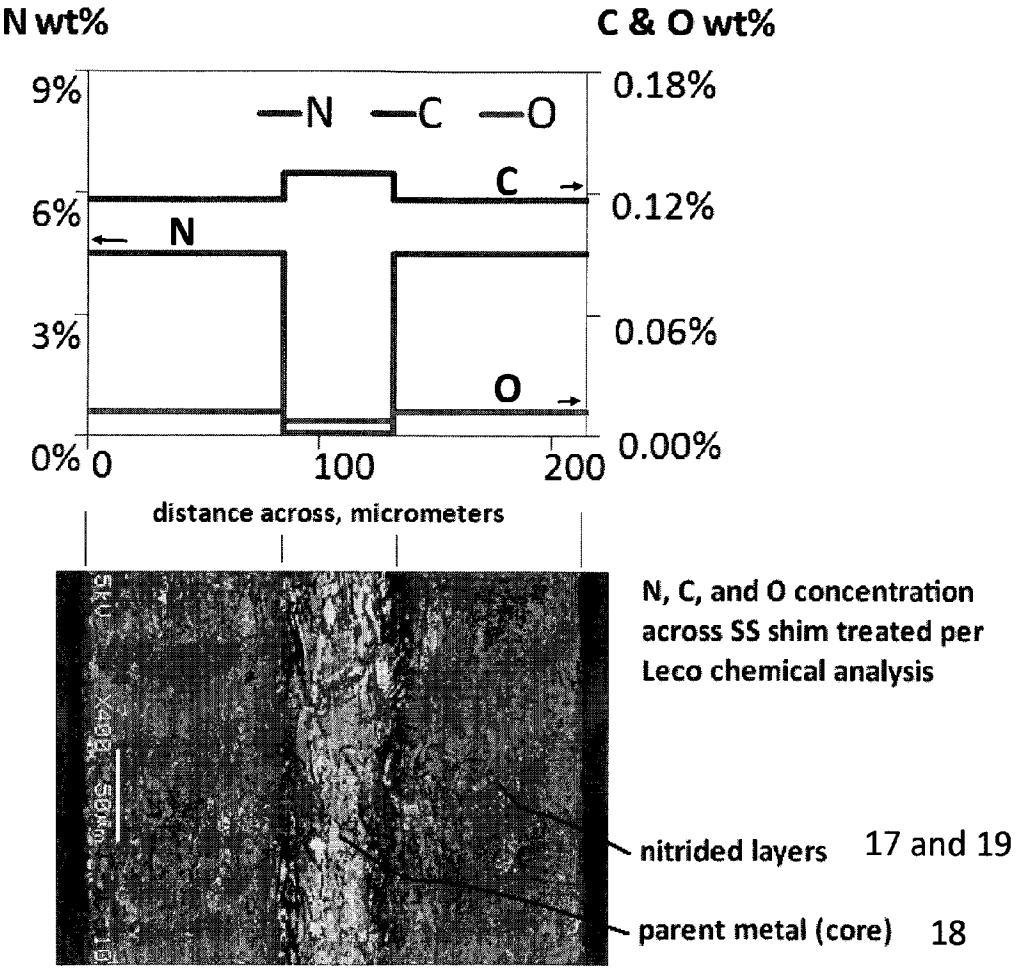
FIGS. 6*a* and 6*b* provides the cross-section of the SAE 301 stainless steel coupon of FIG. 3 that was further etched with oxalic acid.

FIG. 6 shows the cross section of the same, nitrided 301 SS shim, this time etched with oxalic acid in order to reveal grains in the nitrided layers and in the unaffected, parent metal core, here visible as a narrow strip in the center of the microscopic image. Elemental chemical analyses were carried out on raw and nitrided 301 SS shims for nitrogen (N), carbon (C) and oxygen (O) using a Leco combustion gas extraction analyzer. The results are plotted directly above the image of the cross-section. It is apparent that the nitrided layers contain about 5 wt % of nitrogen while the N-content in the parent metal is zero. The O-level in the nitrided layers is very low, about 0.01 wt %, not much more than in the parent metal. Finally, the C-level in the nitrided layers is below 0.12 wt %, less than in the parent metal. The drop in carbon in the nitrided layer can be explained by the nitrogen dilution effect: the relative concentration of carbon, as well as metallic elements of the parent material dropped due to the large infusion of nitrogen. This confirms that, with the electric arc discharge activation and for the $NH_3/CH_4$ molar ratio used in this example (25:1.25), the $CH_4$-containing atmosphere of this invention does not need to carburize the metal treated but accelerates the nitriding on alloys containing chromium additions sufficient to passivate metal surface and inhibit nitriding if carried out in a conventional manner. FIG. 6*a* is a SEM micrograph of cross section of the 301 SS shim after the nitriding treatment according to this invention, and FIG. 6*b* is a representation of the distribution of N, C, and O additions plotted (per elemental Leco analysis) across the treated shim as Shown in the image 6*a*, below.

Figure 7:
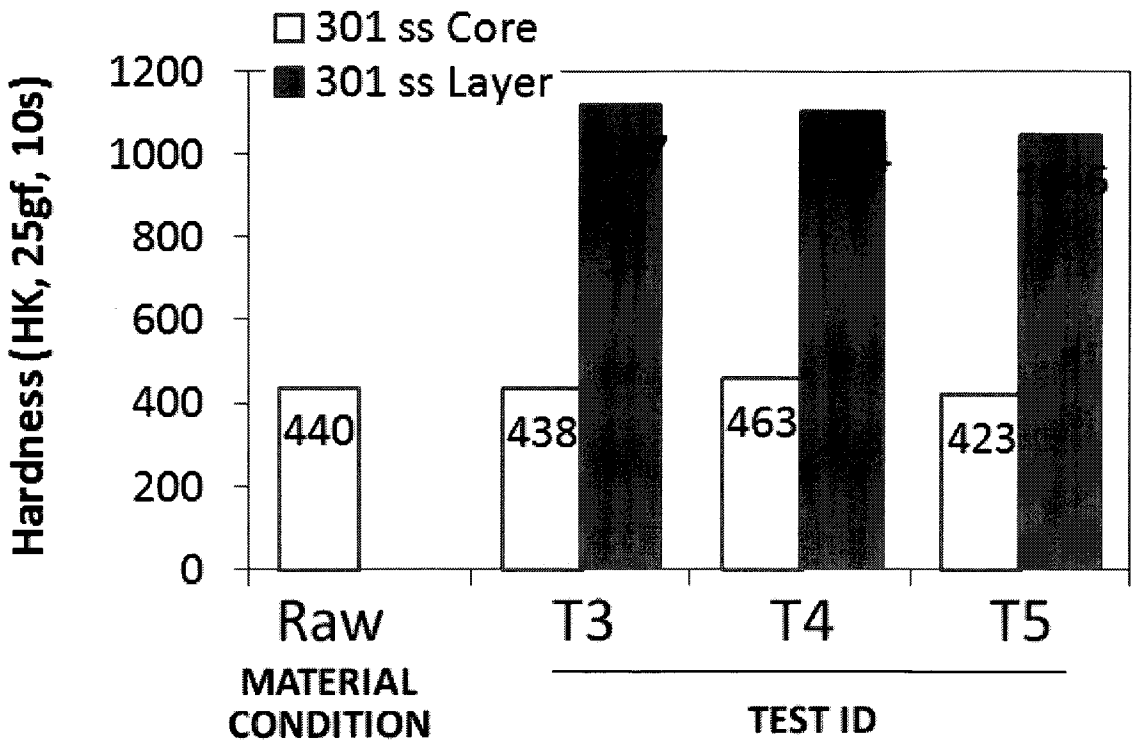
FIG. 7 provides the average hardness gains for 3 different test coupons of 200 micrometer thick SAE 301 stainless steel shims that were treated using the methods described herein.

FIG. 7 illustrates material hardness gains due to the nitriding according to the procedure outlined in FIG. 2 for three different test runs (T3-T5) on samples of the 200 micrometer thick 301 SS shim. The average hardness increase from the core to the nitrided layer is 2.5.

Example 2

Figure 8:
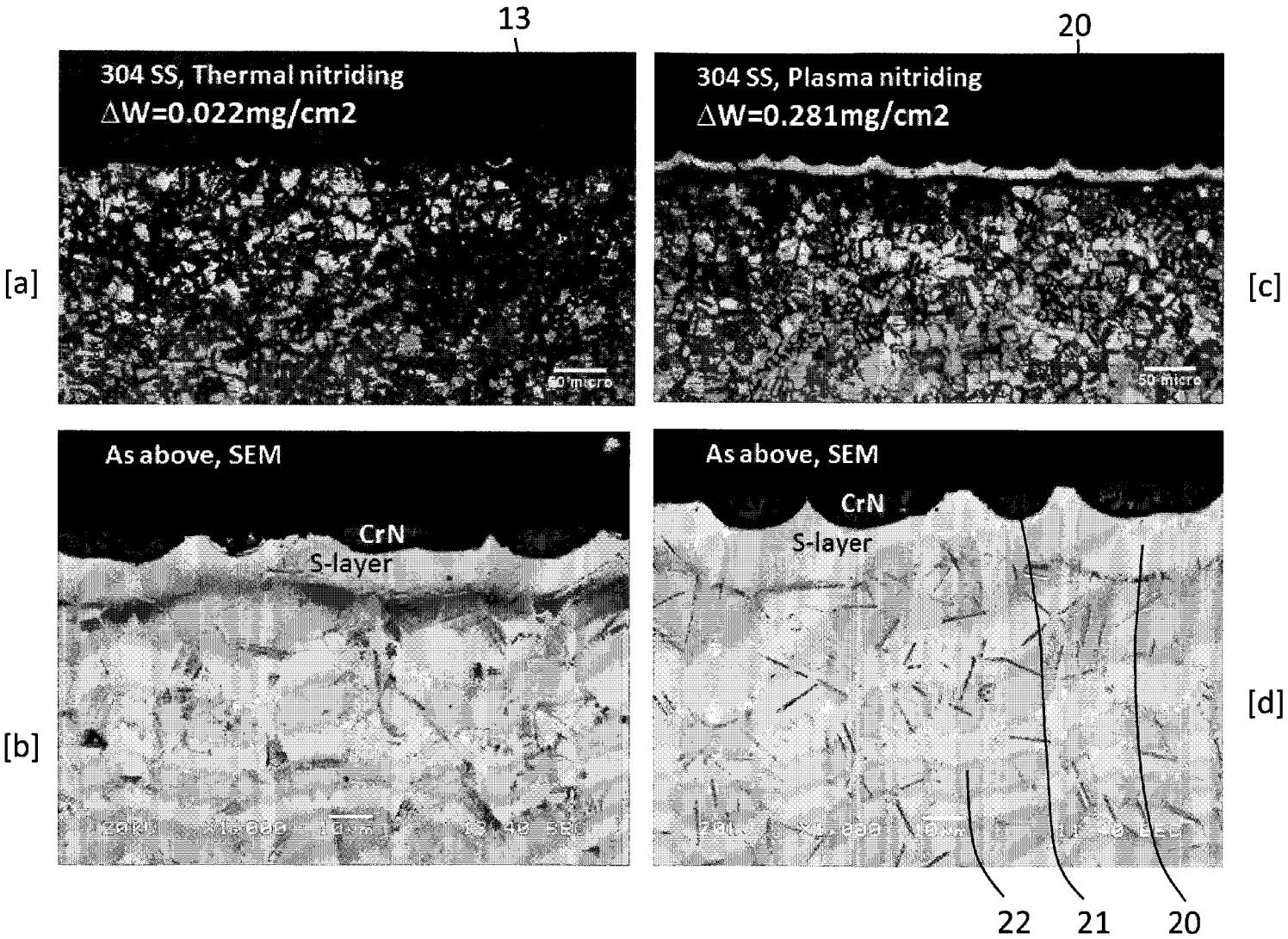
FIGS. 8*a* through 8*d* provide optical (8*a* and 8*c*) and SEM (8*b* and 8*d*) micrographs of austenitic steel SAE 304 stainless steel coupons that show the effect of arc-activation on nitride and S-layers.

Comparison of Conventional, Thermal Nitriding and Plasma Activated Nitriding of a SAE 304 SS Metal Article Metal articles comprised of an austenitic 304 SS were nitrided in $N_2$—$NH_3$—$CH_4$ atmosphere using the heat treating schedule described in Example 1 and in FIG. 2, except that the nitriding temperature was reduced to 500° C. During the nitriding treatments, the gas atmosphere was either conventional, thermal, not activated by the plasma discharge (FIGS. 8*a* and 8*b*) or plasma activated (FIGS. 8*c* and 8*d*). FIG. 8 presents optical (upper 2 pictures) and scanning electron (lower 2 pictures) micrographs of strong acid etched cross sections of austenitic steel 304 SS coupons treated for 4 hours in the $N_2$—$NH_3$—$CH_4$ atmosphere described herein at a temperature of 500° C. The etching acid, including 50% HCl, 25% $HNO_3$ and distilled water, revealed so-called S-layer, i.e. a thermally metastable layer of austenitic (FCC) structure containing large quantities of N dissolved in austenitic metallic matrix. Shown in FIG. 8 are: 20—the S-layer, 21—the alloyed nitride nucleate comprising primarily Cr-nitride, and 22—the metal core. [a] is the sample treated without arc-activation of the treatment atmosphere, [b] is the magnified view of image [a], [c] is the sample treated with arc-activation of the treatment atmosphere, and [d] is the magnified view of image [c]. Due to an apparently too long treatment time and/or too high treatment temperature, the S-layer produced in the 1$^{st}$ treatment stage became decorated with small nuclei of Cr-nitrides growing from the outer surface in. An important finding of this reduced-temperature, 500° C. test, is that the S-layer grown, and the coupon weight gain, delta W, were larger for the $N_2$-25 vol % $NH_3$—1.25 vol % $CH_4$ atmospheres activated with electric arc at the inlet to the furnace. This example shows that electric activation is important especially during nitriding of more alloyed stainless steels and/or during nitriding at lower temperatures.

Elemental analysis of the typical S-layers decorated with nitrides, as those acid-etched from FIG. 8, is shown in FIG. 9. Moving from the left, FIG. 9 shows the topography of the nitride, the S-layer and the parent metal, the Cr-enrichment and the absence of a relatively non-reactive nickel (Ni) in the top nitride phase, the absence of chlorine (Cl) in the S-layer indicating its increased resistance to acid attack, and the uniform distribution of iron (Fe) across the material, except the Cr-enriched nitrides. The data presented in FIG. 9 suggests that after further adjusting the time and temperature of the treatment, it is possible to grow corrosion resistant S-layers using the method of described herein without the use of expensive and toxic etchants and/or vacuum plasma ion nitriding chambers. Marked in FIG. 9 are: [a]—backscattered electron image of sample topography, [b]—Cr-map with the Cr-rich areas seen in lighter color, [c]—Ni-map with the Ni-rich areas seen in lighter color, [d]—chlorine (Cl) map with the Cl-rich areas seen in lighter color and indicating an increased corrosion rates and microroughness of metal surface, and [e]—Fe-map with the Fe-rich areas seen in lighter color.

Example 3

Figure 10:
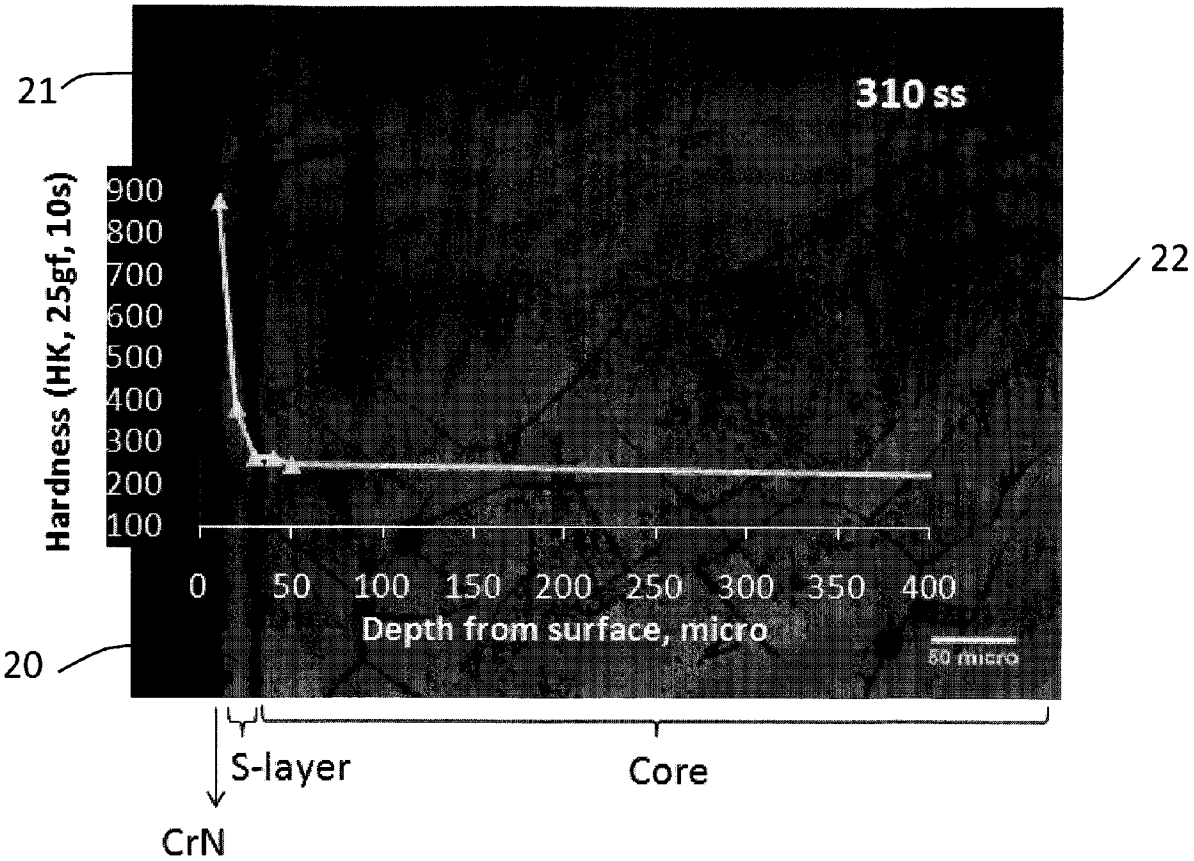
FIG. 10 provides the microhardness profile of nitrided stainless steel SAE 310 coupons that was treated using the method and schedule illustrated in FIG. 2.

Nitriding of a SAE 310 Stainless Steel Coupon Using a Plasma Activated Nitriding Gas Atmosphere Containing Methane Microhardness was measured on cross-section of a 310 SS sample treated according to the procedure detailed in Example 1, e.g., at a temperature of 565° using plasma arc activation of the nitriding gas comprised of 25 vol. % $NH_3$, 1.25 vol. % $CH_4$, and the balance $N_2$. The higher temperature was selected due to the fact that 310 SS is more thermally stable and contains more Cr (24-26 wt %) and Ni (19-22 wt %) than 304 or 301 SS grades. The electric arc discharge activation of the nitriding gas stream was used after it was found necessary for initiating the surface nitriding. The resultant nitrided layers along with microhardness profile are shown in FIG. 10. The layers grown were relatively planar and continuous, and included an about 30 micrometer thick S-layer covered from the top with a 12 micrometer thick Cr-nitride layer. The maximum hardness at the surface was 900 HK, about 3.6-times higher than the hardness of the parent metal. The further refinement of these treatment conditions is expected to maximize one or another surface layer as desired from the end-use standpoint.

Example 4

Nitriding of a SAE 304 SS Coupon Using a Plasma Activated Nitriding Gas Atmosphere Containing Propane Two additional tests of the method described in Example 1 and in FIG. 2, were conducted using propane gas in place of methane in the nitriding gas atmosphere. Thus, the gas blend injected into the furnace via plasma arc injector consisted of 25 vol % $NH_3$, 1.0 vol % $C_3H_8$ and the balance of $N_2$. In the 1$^{st}$ test, the electric power to the plasma injector was off, i.e. the gas blend entering the furnace was not activated. In the 2$^{nd}$ test, the electric power to plasma injector was on, i.e. the gas blend was activated and partially reacted within the arc discharge zone just prior to entering the furnace and contacting the surface of metal to be treated. Both tests used 'as-supplied' 304 SS coupons as the metal load, i.e. no surface pre-treatment were used prior to nitriding. Both tests used the same treatment schedule: about 30 minute heating from room temperature to treatment temperature of about 565° C. under pure $N_2$, about 4 hour nitriding step under the $N_2$—25 vol % $NH_3$—1.0 vol % $C_3H_8$ blend, and cooling inside the furnace under pure $N_2$ to room temperature taking approximately 3 hours. Visual examination of the resultant coupon surfaces indicated that only the coupons processed with the plasma arc discharge on became nitrided. An optical emission spectroscopy analysis (OES) was carried out on the processed coupons and the results are presented in Table 3.

TABLE 3

| Test | Plasma Activation | N wt % | C wt % | Cr wt % | Ni wt % | Mn wt % | Fe wt % |
|---|---|---|---|---|---|---|---|
| 1 | Off | 0.060 | 0.042 | 19.32 | 8.26 | 2.38 | 68.3 |
| 2 | On | 4.450 | 0.172 | 18.42 | 7.42 | 2.21 | 65.8 |

The OES results confirm that surface nitriding took place only when the plasma arc discharge was turned on as indicated by high N wt % as well as the reduced or diluted concentrations of metallic matrix: Fe, Cr, Ni, and Mn. Of note, the use of 1.0 vol % $C_3H_8$ addition to $N_2$-25 vol % $NH_3$, in place of 1.25 vol % $CH_4$ used before, resulted in a marginal carbon gain in the metal surface: from 0.042 to 0.172 wt %. Although higher than in the case of the $N_2$-25 vol % $NH_3$-1.25 vol % $CH_4$ treatment, this carbon gain could be reduced, if undesired in certain applications, by simply reducing the concentration of the inlet $C_3H_8$ from 1.0 to, say, 0.5 vol %. And conversely, the extent of carbon pick-up during this nitriding treatment can be increased by reducing the ammonia-to-hydrocarbon molar ratio in the inlet stream from 25:1 used in Example 4 to 20:1 or even less. The control of this molar ratio, combined with the use of more or less thermodynamically stable hydrocarbon gas, and a larger or smaller electric arc discharge energy input into feed gas stream is, therefore, the practical method for producing hard surface layers, transitioning from nitrides to nitrocarbides and carbonitrides, on metal alloys which tend to passivate during the conventional nitriding, nitrocarburizing, and carbonitriding treatments.

Example 5

High Temperature Treatment of 304 SS Using Nitrogen-Containing Atmosphere and Nitrogen and Methane Containing Atmosphere High temperature treatments were conducted on four 304 stainless steel test coupons using an experimental setup similar to that depicted in FIG. 1. In the high-temperature tests, the nitriding gas atmosphere contained molecular $N_2$ only as the nitrogen source gas; no $NH_3$ was used. The 304 stainless steel coupons were treated at a process temperature of 1100° C. for a time of 4 hours with the only variable changed being atmosphere condition and the plasma activation. For those coupons which were subjected to plasma activation, the activation was run non-stop or continuously during the 4 hour treatment cycle. Table 4 provides the experimental process parameters that were used for each 304 ss test coupon.

TABLE 4

| Test Coupon | Nitriding Atmosphere | Activation |
|---|---|---|
| T6 (N-T) | $N_2$ | None |
| T7 (N-A) | $N_2$ | AC plasma |
| T8 (M-T) | $N_2$ + 1.5% $CH_4$ | None |
| T9 (M-A) | $N_2$ + 1.5% $CH_4$ | AC plasma |

The test coupons were examined by SEM. Comparing the non-activated (T6 or N-T) nitrogen atmosphere run with electric-arc activated (T7 or N-A) run, more nitrogen was observed to be picked up by the parent metal. The SEM observations show that the reaction is clearly been accelerated and higher surface hardness and deeper case depth were produced by arc-activated run. The results of the cross-sectional hardness profile are provided in FIG. 11. FIG. 11 shows that the hardness increased from 200 to 350 HK and several hundred micron case depth was generated. From the hardness result, test coupons which were treated in atmospheres containing methane had the highest hardness, e.g., 450-500 HK surface hardness.

Figure 12:
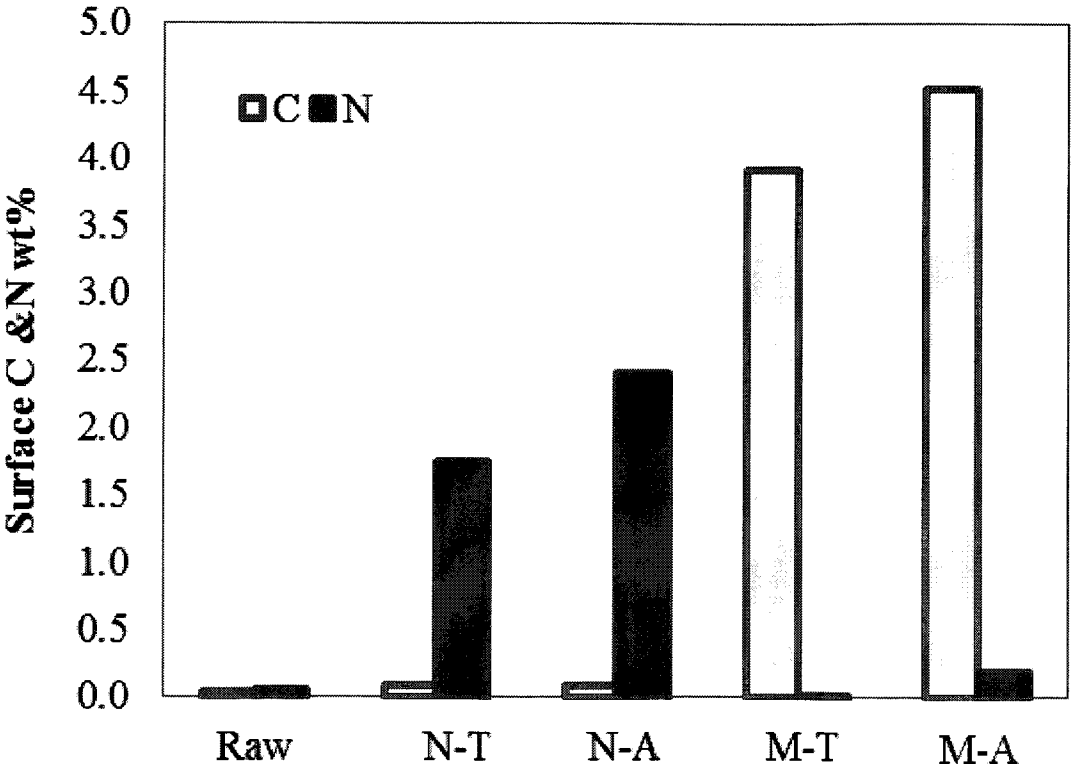
FIG. 12 provides surface concentrations for nitrogen (N) and carbon (C) for the various SAE stainless steel 304 test coupons described in Example 4.

An analysis of the surface concentration expressed in percent of N and C before and after treatment is provided in FIG. 12. Referring to FIG. 12, the test coupons which excluded methane addition (T6 or N-T and T7 or N-A) in the nitriding atmosphere show only nitriding of the steel. By contrast, the test coupons which included methane addition in the nitriding atmosphere show zero nitriding for the conventional, thermal treatment, and carburizing (T8 or M-T), and carburizing combined with some nitriding or carbonitriding for the plasma treatment (T9 or M-A).

It is recognized by those skilled in the art that changes may be made to the above-described embodiments of the invention without departing from the broad inventive concepts thereof. It is understood, therefore, that this invention is not limited to the particular embodiments disclosed but is intended to cover all modifications which are within the full scope of the claims.

The invention claimed is:

1. A method of nitriding a metal article comprising at least one selected from stainless steels, a superalloy, a tool steel, a bearing steel, a cast iron product, or combinations thereof to provide a treated surface comprising:

a. providing the metal article within a furnace operating at an approximately atmospheric pressure;

b. introducing into an inlet of the furnace a gas atmosphere comprising a nitrogen source gas and a hydrocarbon gas wherein the gas atmosphere is substantially free of an added oxygen gas or oxygen-containing source gas wherein the introducing step is conducted by injecting the gas atmosphere through an electric arc-activation apparatus comprising: a low-power, high-voltage, non-pulsed, AC arc discharge, changing polarity from 50 to 60 times per second, where the peak-to-valley voltage ranges from 1 kV to 12 kV and the arc discharge current does not exceed 1 ampere; and c. heating the metal article in the gas atmosphere at one or more nitriding temperatures ranging from about 350° C. to about 1150° C. for a time sufficient to provide the treated surface.

2. The method of claim 1 wherein the metal article comprises an alloy comprised of at least 10.5 weight % Cr and at least 0.2 wt % of an alloying addition selected from the group consisting of Mn, Si, Al, V, Nb, Ti, Zr, and combinations thereof.

3. The method of claim 1 wherein the nitrogen-source gas is at least one selected from nitrogen, ammonia, and combinations thereof.

4. The method of claim 1 wherein the hydrocarbon gas comprises at least one selected from the group consisting of: ethylene ($C_2H_4$), propylene ($C_3H_6$), methane ($CH_4$), propane ($C_3H_8$), acetylene ($C_2H_2$), or combinations thereof.

5. The method of claim 4 where the hydrocarbon gas comprises $CH_4$.

6. The method of claim 1 wherein the nitriding gas atmosphere comprises nitrogen, ammonia, and at least one hydrocarbon gas.

7. The method of claim 6 wherein the molar ratio of ammonia to hydrocarbon gas in the nitrogen-ammonia-hydrocarbon gas blends is controlled using a centralized processing unit.

* * * * *